US006273096B1

(12) United States Patent
Mbonisi

(10) Patent No.: US 6,273,096 B1
(45) Date of Patent: Aug. 14, 2001

(54) HAIR ROLLER HAVING A SMOOTH OUTER SURFACE

(75) Inventor: Talibah A. Mbonisi, College Park, GA (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/596,684

(22) Filed: Jun. 19, 2000

(51) Int. Cl.[7] ..... A45D 2/24
(52) U.S. Cl. ..... 132/258; 132/246
(58) Field of Search ..... 132/246, 247, 132/257, 258

(56) References Cited

U.S. PATENT DOCUMENTS

| | | | | |
|---|---|---|---|---|
| D. 381,118 | | 7/1997 | Ehrhardt et al. . | |
| 2,937,649 | * | 5/1960 | Gresham | 132/258 |
| 3,200,826 | * | 8/1965 | Solomon | 132/258 |
| 3,258,016 | * | 6/1966 | Roepnack | 132/258 |
| 3,960,157 | | 6/1976 | Andrews et al. . | |
| 4,004,595 | | 1/1977 | Slavinski . | |
| 4,210,164 | | 7/1980 | Sidelman . | |
| 4,310,008 | | 1/1982 | Lalli . | |
| 4,911,186 | | 3/1990 | Hayden . | |
| 4,984,591 | | 1/1991 | Jacobi . | |
| 5,000,200 | | 3/1991 | Roberts . | |
| 5,025,816 | * | 6/1991 | Jones | 132/247 |
| 5,186,187 | | 2/1993 | Roberts . | |
| 5,727,576 | * | 3/1998 | Eren | 132/247 |
| 5,740,820 | | 4/1998 | Stern . | |
| 5,875,792 | * | 3/1999 | Campbell, Jr. et al. | 132/246 |

* cited by examiner

*Primary Examiner*—Todd E. Manahan
*Assistant Examiner*—David C Comstock
(74) *Attorney, Agent, or Firm*—Foley & Lardner

(57) ABSTRACT

A hair roller for use in curling hair includes a substantially resilient central core having a substantially smooth outer surface. The central core is formed to have hair wrapped around the outer surface. The hair roller may include a hair clip coupled to the central core for substantially holding the hair wrapped around the central core.

10 Claims, 1 Drawing Sheet

FIG. 1
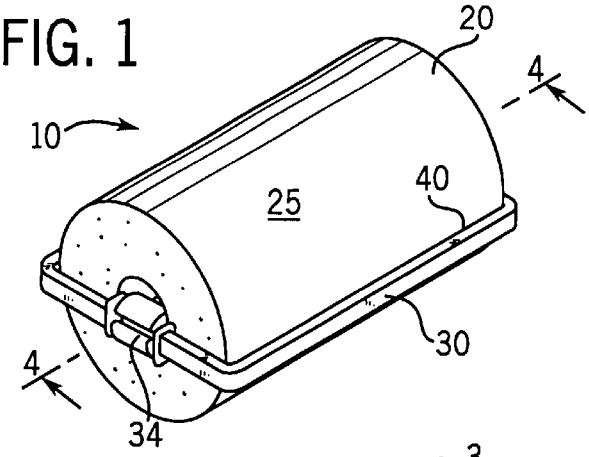
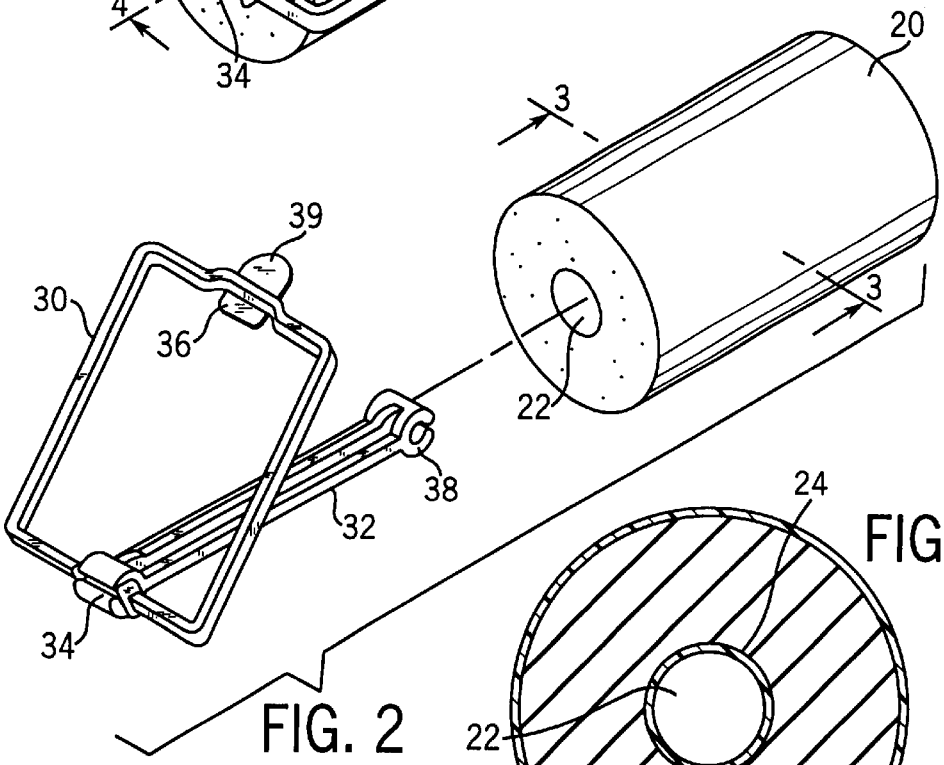
FIG. 2
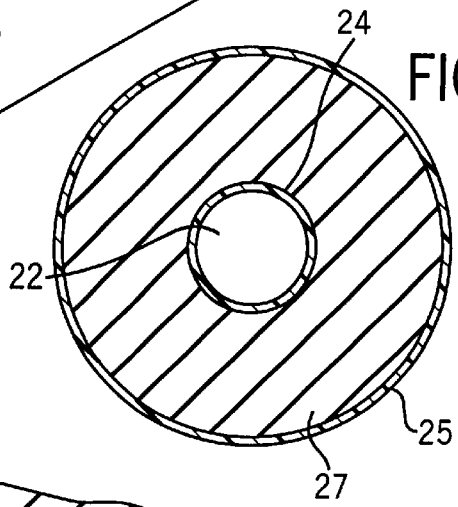
FIG. 3
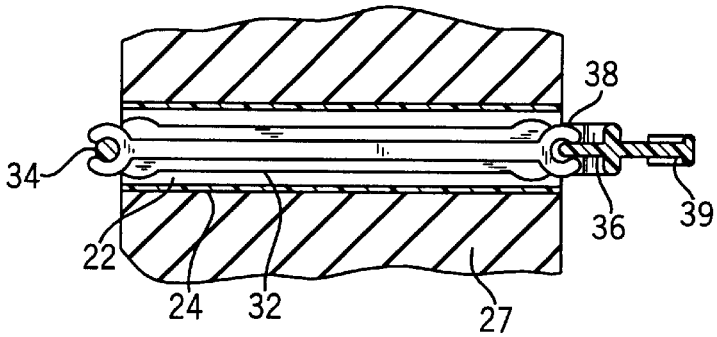
FIG. 4

HAIR ROLLER HAVING A SMOOTH OUTER SURFACE

FIELD OF THE INVENTION

The invention relates to hair rollers which are used for curling human hair. More particularly, the invention relates to a hair roller having a substantially foam core providing flexibility and comfort for the wearer.

BACKGROUND OF THE INVENTION

It is well known in hair dressing to curl a person's hair in order to transform substantially straight hair to curly or wavy hair, thereby satisfying the desire or need for a specific look or the wish of a person to change the appearance of the hair for various reasons. Various types of hair rollers have been developed and used by hair dressers, as well as the general public. Traditionally, hair rollers are formed as a cylindrical-shaped tube on which the hair is rolled. The hair is then secured to the roller so that it remains wrapped around the roller for a certain period of time in order to allow the hair to set in a curled fashion.

Many hair rollers on the market today have a substantially foam core. The foam core is typically a porous open cell foam. Benefits stemming from the use of an open cell foam design include "sleep ability" because the foam is usually soft, users find foam rollers comfortable to sleep with as compared with hard plastic rollers; and tight curls, because of the softness of the rollers, the hair my be rolled tightly resulting in smaller, tighter curls. Conventional foam rollers are often used with "end papers" which are thin sheets of tissue paper that prevent the ends of the hairs being rolled from being caught in the holes of the open cell foam. Failure to use "end papers" with foam rollers often results in undesirable hair breakage.

Therefore, there is need and desire for foam hair rollers including integrated end papers or the like, which prevents hair ends from being caught in the holes of an open cell foam, but does not require the need for separate end papers.

SUMMARY OF THE INVENTION

One embodiment of the invention relates to a hair roller. The hair roller includes a substantially resilient central core having a substantially smooth outer surface. The central core configured to have hair wrapped around the outer surface. The hair roller includes a hair clip coupled to the central core for substantially holding hair wrapped around the central core.

Another exemplary embodiment of the invention relates to a roller configured for use in a hair roller. The roller includes an elongate member of a size suitable for wrapping a portion of hair. The elongate member is configured of a flexible and resilient material having a multiplicity of voids formed therein. The elongate member has an outer surface at least partially covering the elongate member, the outer surface being substantially devoid of voids.

Yet another exemplary embodiment of the invention relates to a hair roller. The hair roller includes an elongate member. The elongate member is configured of a flexible and resilient material having a multiplicity of voids formed therein. The hair roller also includes a clip configured to hold hair wrapped around the elongate member. The elongate member has an outer surface at least partially covering the elongate member. The outer surface is substantially devoid of voids.

BRIEF DESCRIPTION OF THE DRAWINGS

The invention will be become more fully understood from the following detailed description, taken in conjunction with the accompanying drawings, wherein like reference numerals refer to like elements in which:

FIG. 1 is a perspective view of a hair roller;

FIG. 2 is an exploded perspective view of the hair roller of FIG. 1;

FIG. 3 is a cross sectional view taken along the line 3—3 in FIG. 2; and FIG. 4 is a cross sectional view taken along the line 4—4 in FIG. 1.

DETAILED DESCRIPTION OF THE EXEMPLARY EMBODIMENTS

Referring now to FIG. 1, hair roller 10 is depicted. Hair roller 10 includes a generally cylindrical core 20 and a frame 30. As depicted in FIG. 2, frame 30 releasably detaches from core 20.

In an exemplary embodiment core 20 is a paper foam core having a substantially smooth outer surface 25 (see FIG. 3) with an interior 27 of open cell foam. Further still, substantially cylindrical core 20 includes a longitudinally extending aperture 22 surrounded by a substantially smooth surface 24.

In use, hair is wrapped around core 20. After the hair is wrapped around core 20 a pin 32 that is rotatably coupled to frame 30 at junction 34 is inserted through aperture 22. Once pin 32 is inserted entirely through aperture 22 a tab portion 36 of frame 30 engages a catch 38 of pin 32 thereby holding frame 30 in place as depicted in FIG. 1. Frame 30 causes hair wrapped around core 20 to remain in the space 40 between frame 30 and core 20, such that the hair does not become unwrapped from core 20. Frame 30 and pin 32 coact as a clip to hold hair in place, once it is wrapped around core 20. A grip 39 is formed on frame 30 to facilitate the releasability of tab 36 from catch 38 due to flexibility of frame 30 and pin 32.

As stated above, in an exemplary embodiment, core 20 is constructed of paper foam available from Goodway (far east) Industries, Inc. of Hong Kong. Paper foam is a material having an open celled foam interior and a substantially smooth outer surface. In an exemplary embodiment, the smooth outer surface may be formed by heating the outer surface of an open cell foam material, causing melting and smoothing of the outer surface. The formation of a substantially smooth skinned core, is however not limited to the creation of the substantially smooth surface by the aforementioned method. Alternatively, any other type of a skinned foam with a smooth outer surface that is integrated into the flexible or foam core may be used, such that hair ends are prevented from entering open cell portions of the foam, and thereby hair ends are prevented from breakage. Further, other types of flexible and resilient cores may be used, the flexible and resilient cores having at least a partially smooth outer surface. The substantially smooth outer surface of the central core of the hair roller may also provide for prevention of hair entanglement because the hair ends will not catch in the open cell foam.

Because of the substantially smooth outer surface of core 20, application to the hair is substantially improved. When a user wraps wet hair around core 20, wet hair tends to adhere to the surface of core 20 due to the inherent surface tension of water and because the substantially smooth surface, in an exemplary embodiment, is not an absorbent surface. In contrast, open cell foam rollers having an open cell outer surface absorb water from the hair and prevent the hair from adhering to the surface of the foam roller, making it more difficult to begin the rolling process.

Further, because of the substantially smooth outer surface of core 20, removal of hair from roller 1 0 is facilitated. As hair is being removed from roller 10, hair ends do not catch on core 20, in contrast to rollers with an open cell outer surface. Because hair does not catch on the substantially smooth outer surface of core 20, less fraying of the curls is caused, resulting in a smoother curl. Further still, the substantially smooth outer surface of core 20 provides smooth curls because substantial kinking of the hair is avoided.

Yet further still, because, in an exemplary embodiment, the substantially smooth outer surface may not be substantially absorbent, wet hair is readily exposed to the air and can be dried readily. In contrast, use of open cell rollers, which are absorbent, wick moisture out of the hair and the roller remains wet for a longer period of time, because evaporation is prevented by the barrier of hair wrapped around the core. The exposed ends of the rollers, however, remain wet and touch the scalp, or other objects coming in contact with the head (such as pillows and furniture), causing both discomfort and inconvenience.

In an alternative embodiment, frame 30 may be comprised of any flexible materials, such as plastics and metals such as, but not limited to, aluminum.

While the detailed drawings, specific examples, and particular configurations given describe exemplary embodiments, they serve the purpose of illustration only. The materials and configurations shown and described may differ depending on the chosen performance characteristics and physical characteristics of the hair roller. For example, the size and shape of the central core may differ. The systems shown and described are not limited to the precise details and conditions disclosed. Furthermore, other substitutions, modifications, changes, and omissions may be made in the design, operating conditions, and arrangement of the exemplary embodiments without departing from the spirit of the invention as expressed in the appended claims.

What is claimed is:

1. A hair roller, comprising:

a substantially resilient central core having a substantially smooth outer surface, the central core configured to have hair wrapped around the outer surface; and a hair clip coupled to the central core for substantially holding hair wrapped around the central core.

2. The hair roller of claim 1, wherein the central core is made of a paper foam.

3. The hair roller of claim 1, wherein the clip includes a pin and a frame.

4. The hair roller of claim 3, wherein the clip frame is rotatably coupled with the pin.

5. The hair roller of claim 1, wherein the central core has an interior that is substantially an open cell foam material.

6. A hair roller, comprising:

an elongate member of a size suitable for wrapping a portion of hair, the elongate member configured of a flexible and resilient material having a multiplicity of voids formed therein, a hair clip coupled to the elongate member for substantially holding hair wrapped around the elongate member;

wherein the elongate member has an outer surface at least partially covering the elongate member, the outer surface being substantially smooth.

7. The hair roller of claim 6, wherein the roller is made of a paper foam.

8. The hair roller of claim 6, wherein the roller has a longitudinal aperture extending the length of the elongate member.

9. The hair roller of claim 6, wherein the roller is configured to be coupled to a clip for holding hair wrapped around the outer surface.

10. The hair roller of claim 6, wherein the elongate member is substantially cylindrical.

* * * * *